US007654475B2

(12) United States Patent
Ando et al.

(10) Patent No.: US 7,654,475 B2
(45) Date of Patent: Feb. 2, 2010

(54) FUEL INJECTION VALVE

(75) Inventors: Junnosuke Ando, Kanagawa (JP); Kazuhiro Kawai, Kanagawa (JP)

(73) Assignee: Mitsubishi Heavy Industries, Inc., Tokyo (JP)

( * ) Notice: Subject to any disclaimer, the term of this patent is extended or adjusted under 35 U.S.C. 154(b) by 0 days.

(21) Appl. No.: 12/086,629

(22) PCT Filed: Aug. 3, 2007

(86) PCT No.: PCT/JP2007/065672

§ 371 (c)(1),
(2), (4) Date: Aug. 1, 2008

(87) PCT Pub. No.: WO2008/026438

PCT Pub. Date: Mar. 6, 2008

(65) Prior Publication Data

US 2008/0308657 A1 Dec. 18, 2008

(30) Foreign Application Priority Data

Aug. 31, 2006 (JP) ..... 2006-236064

(51) Int. Cl.

| | |
|---|---|
| ***F02M 61/10*** | (2006.01) |
| ***F02M 61/16*** | (2006.01) |
| ***F02M 61/00*** | (2006.01) |
| ***F23D 11/38*** | (2006.01) |
| *F02M 51/06* | (2006.01) |
| *F02M 51/00* | (2006.01) |

(52) U.S. Cl. ..... 239/533.2; 239/114; 239/115; 239/116; 239/123; 239/460

(58) Field of Classification Search ..... 239/114–118, 239/123, 456, 457, 460, 533.2, 533.3, 584, 239/585.1–585.5
See application file for complete search history.

(56) References Cited

U.S. PATENT DOCUMENTS 5,645,225 A * 7/1997 Hasegawa et al. ..... 239/533.12

(Continued)

FOREIGN PATENT DOCUMENTS

EP 1 156 209 11/2001

(Continued)

OTHER PUBLICATIONS

International Search Report mailed Oct. 23, 2007 for International Application No. PCT/JP2007/065672.

*Primary Examiner*—Darren W Gorman
(74) *Attorney, Agent, or Firm*—Wenderoth, Lind & Ponack, L.L.P.

(57) ABSTRACT

A fuel injection valve has a first groove cut in a peripheral surface of a needle valve and second grooves cut in a seat surface of a nozzle tip. The first groove is provided so that the needle valve is rotated by flow of the fuel in the first groove caused by a reciprocating motion of the needle valve, and upper and lower ends of the first groove are opened to the outside so that the fuel can be introduced into the groove. The second grooves are twisted or tilted in the same direction as the rotating direction of the needle valve and are cut along the circumferential direction of the nozzle tip. The second grooves have an edge part for scraping off solid matters into the second grooves in cooperation with the tip seat surface of the needle valve by the rotation of the needle valve.

6 Claims, 9 Drawing Sheets

U.S. PATENT DOCUMENTS

| | | | | |
|---|---|---|---|---|
| 5,947,389 | A * | 9/1999 | Hasegawa et al. | 239/533.2 |
| 5,975,433 | A * | 11/1999 | Hasegawa et al. | 239/533.12 |
| 5,979,802 | A * | 11/1999 | Hasegawa | 239/533.12 |
| 6,477,940 | B1 | 11/2002 | Danckert et al. | |
| 2002/0092929 | A1 * | 7/2002 | Arimoto | 239/533.3 |
| 2004/0035954 | A1 * | 2/2004 | Carlise et al. | 239/584 |
| 2005/0205693 | A1 | 9/2005 | Teschner et al. | |

FOREIGN PATENT DOCUMENTS

| | | |
|---|---|---|
| JP | 7-103106 | 4/1995 |
| JP | 11-230006 | 8/1999 |
| JP | 2002-295342 | 10/2002 |
| JP | 2005-533222 | 11/2005 |
| WO | 2006/033379 | 3/2006 |

* cited by examiner

An example of View "X" in Fig. 6
(interrupted grooves)

An example of View "X" in Fig. 6
(uninterrupted line grooves)

Fig. 11

An example of measured foreign substances distribution

| | | | Low sulfer diesel oil | High grade diesel oil | Gas oil |
|---|---|---|---|---|---|
| Foreign substances (Counting technique) | 5～15 μm | 100ml | 329,000 | 33,700 | 3,460 |
| | 15～25 μm | 100ml | 18,500 | 3,010 | 700 |
| | 25～50 μm | 100ml | 2,560 | 1,030 | 315 |
| | 50～100 μm | 100ml | 105 | 110 | 25 |
| | 100 μm～ | 100ml | 10 | 30 | 0 |
| | NAS Grade | | 11 | 8 | 6 |

FUEL INJECTION VALVE

BACKGROUND OF THE INVENTION

1. Technical Field

The present invention relates to a fuel injection valve such as a pilot fuel injection device in a gas engine, or a fuel injection device in a diesel engine, whereby the injection valve injects fuel supplied in a fuel pool surrounding a needle valve into an engine cylinder. The injection valve stops the fuel injection in a way such that a fuel flow channel between a tip of the needle valve and a valve seat of a nozzle tip is opened or closed by a reciprocating movement of the needle valve that is fitted slidably and guided in the nozzle tip.

2. Related Art

As is shown in patent reference 1 (JP2002-295342), a fuel injection valve applied to a pilot fuel injection device in a gas engine, a fuel injection device in a diesel engine, or the like, injects fuel supplied in a fuel pool surrounding a needle valve into an engine cylinder through at least one nozzle hole provided at a tip of a nozzle tip, and also stops the injection, using a fuel flow passage between a seat surface of the needle valve tip and a seat surface of the nozzle tip which is opened/closed by reciprocating movements of a needle valve fitted slidably in a borehole formed in the nozzle tip.

In a medium size or large size gas engine for generators and diesel engines which are provided with the fuel injection valve as mentioned above, diesel oil is frequently used as a fuel (in large marine-diesel engines, heavy fuel oil and/or heavy duty fuel is usually used).

The fuel used in the fuel injection valves for diesel fuel is apt to contain relatively large amounts of foreign substances, causing the foreign substances to often enter a sliding clearance around the needle valve. Moreover, impurities are sometimes introduced into fuel oil during engine maintenance, and the fuel oil introduces the impurities into the sliding clearance around the needle valve. The above-mentioned foreign substances or impurities on the sliding surfaces often cause a malfunction, wear or seizure of the needle valve.

When burnt, diesel oil generates more combustion residues than gas oil does; thus, in an injection valve of an engine that is operated with diesel oil, a considerable amount of combustion residue accumulates in the neighborhood of the valve-seat surfaces around the needle valve, which easily induces poor combustion caused by irregular injections because of the accumulated hard residues exfoliating from the surfaces and scratching the surfaces.

Patent reference 1 (JP2002-295342) discloses a needle valve that has a plurality of radial grooves around the outer periphery of the needle valve so as to improve a lubricating condition between the periphery of the needle valve and the nozzle tip.

Patent reference 2 (JP2005-533222) discloses a fuel injection valve that has a plurality of micro-depressions configured on the seat surfaces of the needle valve tip and/or the nozzle tip so as to improve the lubricating condition mentioned above using fuel held in the depressions as a lubricant.

As mentioned above, in fuel injection valves which use a fuel such as diesel oil containing a relatively large amount of foreign substances, the foreign substances or impurities introduced by the fuel oil itself or through engine maintenance work often enter the sliding clearance around the needle valve. Moreover, the diesel oil yields a considerable amount of combustion residue which is apt to damage the seat surfaces of the needle valve tip and/or the nozzle tip.

FIG. 11 shows an example of foreign substance distribution in a diesel oil sample and a gas oil sample. The data shows that the distribution quantity of the foreign substances in the diesel oil is 10 to 100 times higher than that in the gas oil when a particle size of the foreign substances is 5 to 15 μm.

In the disclosure of patent reference 1, even though the needle valve is provided with a plurality of radial grooves around the outer periphery of the needle valve for a purpose of improving a lubricating condition between the periphery of the needle valve and the nozzle tip, the purpose of the grooves is mainly to improve lubrication by means of retaining fuel oil in the grooves. Thus, each groove is not open to the outside, so foreign substances and/or impurities that are brought therein are apt to enter the sliding clearance around the needle valve through the reciprocating movements of the needle valve. Therefore, even with the technology disclosed in the patent reference 1, intrusion of foreign substances and/or impurities into the sliding clearance around the needle valve still easily occurs, and the problems of malfunctions, wear or seizure of the needle valve periphery remain unsolved.

Further, in the disclosure of patent reference 2, a plurality of micro-depressions are configured on the seat surfaces of the needle valve tip and/or the nozzle tip so as to improve the lubricating condition by the fuel oil remaining in the depressions as a lubricant. However, the seat surface of the needle valve tip comes in contact with the seat surface of the nozzle tip so that the areas of contacting surfaces are kept substantially unchanged. Thus, when combustion residues, foreign substances, impurities, and so on, intrude into the seat areas, those solid foreign-matters are not removed from the micro-depressions, even if the depressions improve the lubrication. Consequently, there arise problems such as irregular fuel injections and resulting poor combustion, in response to the damage of the solid foreign matters on the seat surfaces.

BRIEF SUMMARY OF THE INVENTION

The present invention is created in view of the mentioned technical background. Even in relation to engines that use fuel including foreign substances to a considerable extent, the subject of the invention is to provide a fuel injection valve that can prevent:

an attack of solid foreign matters such as foreign substances, impurities, or combustion residues on the contacting seat surfaces of a needle valve and/or a nozzle tip, and on the sliding surfaces of the needle valve periphery and/or a corresponding borehole in the nozzle tip, a malfunction and/or seizure of the needle valve through the mentioned attack, and poor combustion due to irregular injections.

The disclosed invention to achieve the goals is a fuel injection valve that injects fuel supplied in a fuel pool surrounding a needle valve into an engine cylinder through at least one nozzle hole perforated in the neighborhood of a tip of a nozzle tip, as well as stops the injection, using a fuel flow passage between a seat surface of the needle valve tip and a seat surface of the nozzle tip is opened/closed by reciprocating movements of a needle valve fitted slidably in a borehole formed in the nozzle tip, comprising:

said needle valve that comprises a first groove which is engraved on an outer periphery thereof so that fuel can be guided in the groove, the upper and lower ends of the groove being open to the outside; thereby, the needle valve can be rotated with the fuel flown in the groove in response to the reciprocating movements, and a nozzle tip that comprises a plurality of second grooves which are engraved on a seat surface therein so that the second grooves are arranged in a direction twisted or inclined in relation to hoop circles around an axis of the nozzle tip, as well as in relation to a rotational direction of the needle valve; whereby, the second groove comprises a sharp edge that scrapes-off deposited solid materials from the fuel which adhere to the seat surfaces of the needle valve and the nozzle tip, into the second grooves, with the help of the relative rotational movements between the seat surfaces.

In a preferable fuel injection valve according to the above, the first groove is connected to a fuel pool at one end so that fuel can be guided into the grooves, while the grooves are connected to a passage toward the outside of the needle valve.

More specifically, the first groove preferably comprises one of:

spiral grooves that are formed on the outer surface of the needle valve, being placed spirally along the center axis thereof, or inclined grooves that are formed on the outer surface of the needle valve, being inclined against the needle longitudinal direction;

whereby, either grooves are connected to a fuel pool at a lower end so that fuel can be guided in the grooves, while being connected to an upper end face of the needle valve.

Further, the second groove preferably comprises one of:

a plurality of grooves that are intermittently engraved on a seat surface of the nozzle tip, either along discontiguous hoop circles, or along a hoop circle, or a plurality of uninterrupted line grooves that are engraved on a seat surface of the nozzle tip, while being placed in inclined directions against hoop circles on the seat surface so that the lines (curves) of the grooves intersect the hoop circles with an inclined angle.

According to the present invention, the first groove is engraved on the outer peripheral surface of the needle valve so that the groove has open connections at lower/upper ends, and fuel can be guided in the groove; preferably, the first groove communicates with a fuel pool on a fuel passage in the injection valve, so as to induce fuel at an end of the groove, while the groove communicates with an outside, i.e. a space over the needle valve toward an air space; more specifically, the first groove is formed with a spiral groove, spirally along a center axis of the needle valve, or the first groove is formed with a plurality of inclined grooves, the grooves being inclined against the needle longitudinal direction. The needle valve can be rotated in response to the reciprocating movements of the needle valve as well as the movements of the fuel guided into the first groove.

Further, according to the present invention, a plurality of the second grooves are engraved on the seat surface of the nozzle tip so that the second grooves are placed along hoop circles of the needle valve rotation, or in uniformly-twisted or uniformly-inclined directions against the hoop directions, whereas a part of the peripheral contour of the second groove comprises a sharp edge that scrapes-off deposited solid materials in the fuel which adhere to the seat surfaces of the needle valve and the nozzle tip. More specifically, a plurality of the second grooves are provided intermittently along hoop circles of the needle valve rotation, or a plurality of the second grooves are provided in uniformly-twisted or uniformly-inclined directions against the hoop directions of the needle valve rotation.

Further, a part of the fuel accumulated in the fuel pool 17 flows in the first groove of the needle valve which communicates the fuel pool of a higher pressure with a space over the needle valve, toward an air space; thereby, the fuel flow makes the needle valve rotate. In to the rotational movements of the needle valve, the solid foreign matters such as foreign substances, impurities, or combustion residues in the fuel which are apt to enter a sliding clearance around the needle valve easily can be carried away into the first groove. Further, the solid foreign matters can be easily discharged with the fuel flow toward the air space. Consequently, inclusion of the foreign matters on the outer surfaces around the needle valve can be evaded.

Thus, a malfunction and/or seizure of the needle valve that are caused by inclusion of solid foreign matters in fuel can be prevented where, the solid foreign matters denote substances such as foreign substances impurities or combustion residues.

Moreover, through the rotational movements of the needle valve with the fuel flow in the first groove, as well as through the sharp edge (a keen edge part of a whole contour edge) of a plurality of the second grooves that are provided on the seat surface of the nozzle tip in uniformly-twisted or uniformly-inclined directions against the hoop directions of the needle valve rotation, the sharp edge scrapes-off deposited solid-materials from the fuel that adhere to the seat surfaces of the needle valve and the nozzle tip. Solid-foreign substances are scraped-off into the second grooves, the substances being those such as foreign substances, impurities, or combustion residues in the fuel which are apt to enter a sliding clearance between the tip part of the needle valve and the seat part (a seat cone) in the nozzle tip.

As a result, an inclusion of the solid foreign-substances around the seat part can be withstood and irregular injection and incomplete combustion thereof are prevented.

Further, the present invention discloses a fuel injection valve that injects fuel supplied in a fuel pool on the way of a fuel passage in the injection valve, into an engine cylinder, through at least one nozzle hole provided in the neighborhood of a tip of a nozzle tip, as well as stops the injection, using a needle valve which opens/closes a fuel flow passage between a seat surface of the needle valve tip and a seat surface of the nozzle tip, by means of sliding along a borehole inside the nozzle tip with reciprocating movements; wherein, a groove is engraved on an outer periphery of the needle valve so that a part of the fuel can flow in the groove, while a process of shot-peening is performed on the outer periphery.

More specifically, the first groove preferably comprises one of:

axial direction grooves that are formed on the outer surface of the needle valve, being placed along a center axis of the needle valve, spiral grooves that are formed on the outer surface of the needle valve, being placed spirally along the center axis of the needle valve, or inclined grooves that are formed on the outer surface of the needle valve, being inclined against the needle's longitudinal direction as well as being connected to a fuel pool at a lower end so that fuel can be guided in the groove, while being connected to an upper end face of the needle valve, at an upper end of the inclined groove.

According to the above invention, the groove is engraved on the outer peripheral surface of the needle valve so as to induce a part of the fuel in the groove. More specifically, the groove is engraved as one of:

an axial direction groove that is formed on the outer surface of the needle valve, being placed along a center axis of the needle valve, a spiral groove that is formed on the outer surface of the needle valve, being placed spirally along the center axis of the needle valve, or an inclined groove that is formed on the outer surface of the needle valve, being inclined against the needle's longitudinal direction as well as being connected to a fuel pool at a lower end so that fuel can be guided in the groove, while being connected to an upper end face of the needle valve, at an upper end of the inclined groove;

On the outer periphery of the needle valve where the groove is not engraved, a process of shot-peening is performed.

Consequently, solid foreign matters in the fuel flow into the grooves, where the solid foreign matters denote substances such as foreign substances, impurities, or combustion residues the substances that are apt to attack the outer periphery of the needle valve. Thus, inclusion of the solid foreign matters on the outer periphery of the needle valve can be evaded. On the other hand, a process of shot-peening is performed on the outer periphery of the needle valve where the groove is not engraved. Thereby, fuel (as a certain lubricant) can be held within the microscopic depressions (dimples); thus, lubrication performance can be enhanced between the mutually sliding surfaces of the needle outer periphery and the nozzle tip bore. Further, wear resistance as to the sliding surfaces is enhanced thanks to increased hardness of the needle outer periphery.

Thus, inclusion of the solid foreign matters on the outer periphery of the needle valve can be evaded, where the solid foreign matters denote substances such as foreign substances, impurities, or combustion residues in fuel. In addition, lubrication performance can be enhanced as well as wear resistance of the mutually sliding surfaces of the needle outer periphery and the nozzle tip bore.

According to the present invention, a part of the fuel accumulated in the fuel pool flows in the first groove of the needle valve which communicates a higher pressure in the fuel pool to a space over the needle valve toward an air space, and the fuel flow makes the needle valve rotate. In response to the rotational movements of the needle valve, solid foreign matters such as foreign substances, impurities, or combustion residues in the fuel, the matters which are apt to enter a sliding clearance around the needle valve can easily be carried away into the first groove. Further, the solid foreign matters can be easily discharged with the fuel flow into the air space. Consequently, inclusion of the foreign matters on the outer surfaces around the needle valve can be evaded.

Thus, a malfunction and/or seizure of the needle valve that is caused by the inclusion of solid foreign matters in the fuel, such as foreign substances, impurities, or combustion residues, can be prevented.

Moreover, according to the present invention, in response to the rotational movements of the needle valve due to the fuel flow in the first groove, as well as through the sharp edge (a keen edge part of the whole contour edge) of a plurality of the second grooves that are provided on the seat surface of the nozzle tip, in uniformly-twisted or uniformly-inclined directions against the hoop directions as to the needle valve rotation, the sharp edge scrapes-off deposited solid-materials from the fuel, the materials that adhere to the seat surfaces of the needle valve and the nozzle tip. Solid foreign substances are scraped-off into the second grooves, substances which are such as combustion residues, foreign substances, or impurities in fuel, which are apt to enter a sliding clearance between the tip part of the needle valve and the seat part (a seat cone) in the nozzle tip.

As a result, an inclusion of the solid foreign-substances around the seat part can be withstood, and irregular injection and incomplete combustion are prevented.

Further more, according to the present invention, due to the provided first grooves, solid foreign matters flow into the grooves, where solid foreign matters denote substances such as foreign substances, impurities, or combustion residues in fuel, the substances which are apt to attack the outer periphery of the needle valve. Thus, inclusion of the solid foreign matters on the outer periphery of the needle valve can be evaded. On the other hand, a process of shot-peening is performed on the outer periphery of the needle valve where the groove is not engraved. Fuel (as a certain lubricant) can be held within the microscopic depressions (dimples); thus, lubrication performance between the mutually sliding surfaces of the needle-outer-periphery and the nozzle tip bore can be enhanced. Further, wear resistance of the sliding surfaces is enhanced due to increased hardness of the needle-outer-periphery.

In this way, inclusion of the solid foreign matters on the outer periphery of the needle valve can be evaded, where solid foreign matters denote substances such as foreign substances, impurities, or combustion residues in fuel. In addition, lubrication performance can be enhanced as well as wear resistance of the mutually sliding surfaces of the needle outer periphery and the nozzle tip bore.

BRIEF DESCRIPTION OF THE DRAWINGS

FIG. 11 shows an example of measured foreign substances distribution as to a diesel oil sample and a gas oil sample.

DETAILED DESCRIPTION OF THE INVENTION

Preferred embodiments of the present invention will now be detailed with reference to the accompanying drawings. It is intended, however, that unless particularly specified, dimensions, materials, relative positions, and so forth, of the constituent parts in the embodiments shall be interpreted as illustrative only, and not as limitative of the scope of the present invention.

Figure 1:
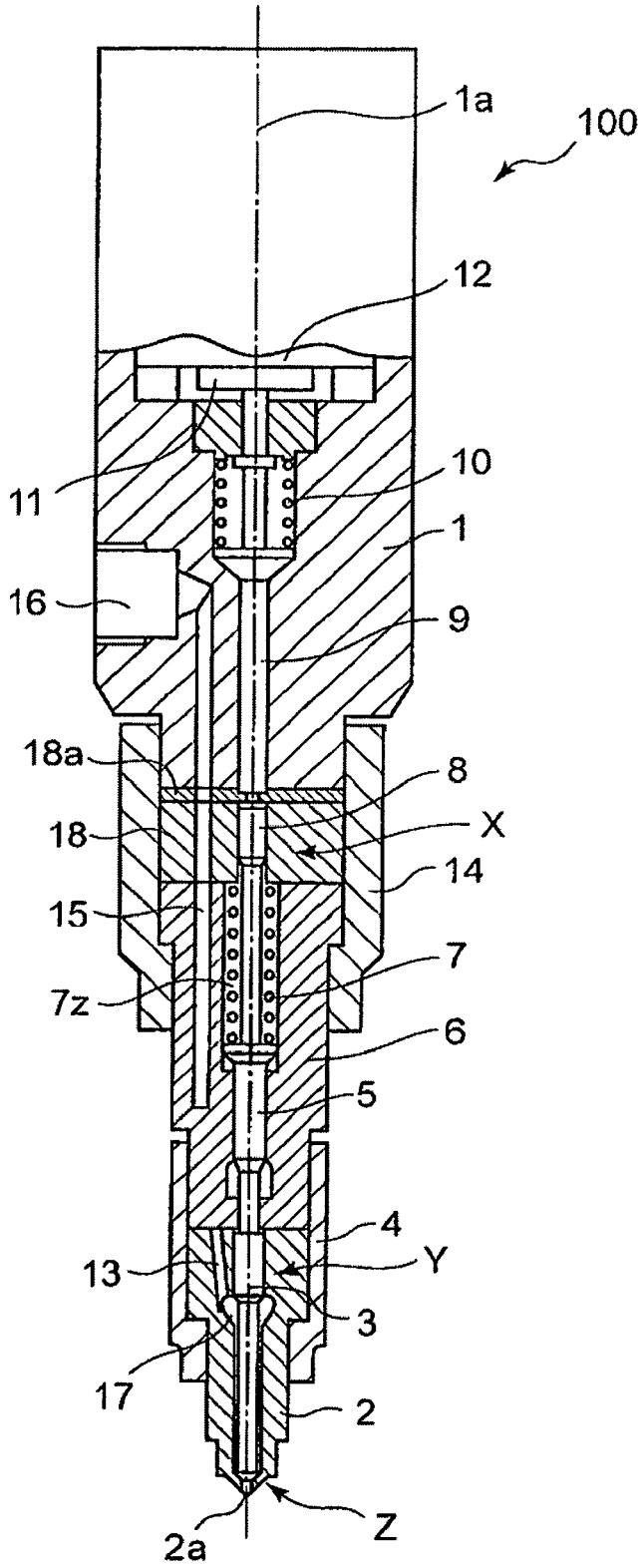
FIG. 1 is a cross section view of a pilot-fuel injection valve applied to a gas engine, along a center axis of the valve.
Figure 2B:
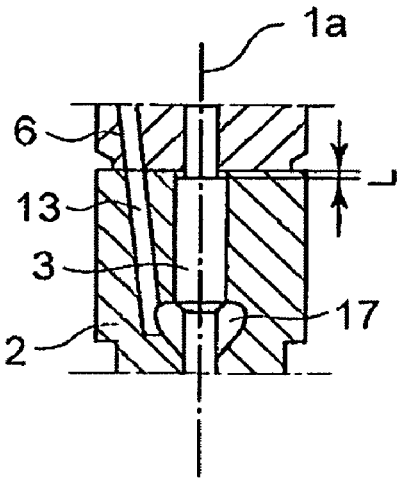
FIG. 2B shows an enlarged detail of the part Y in FIG. 1.
Figure 2A:
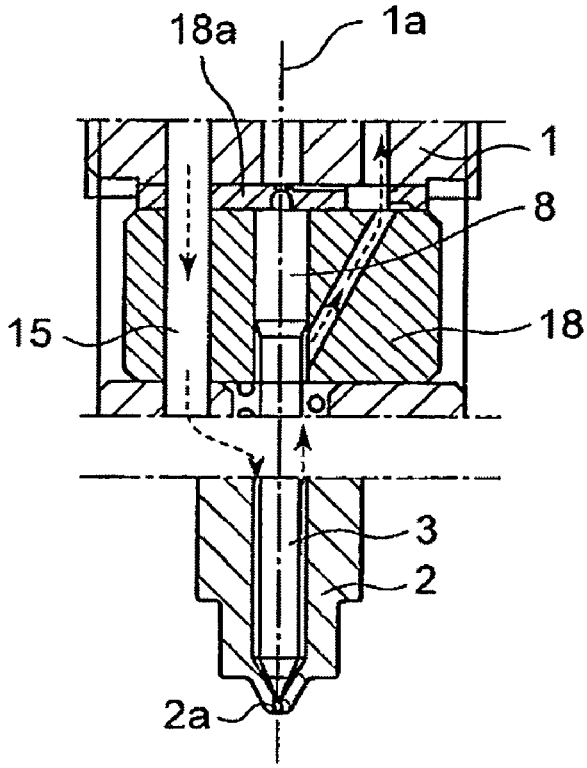
FIG. 2A shows enlarged details of the parts Z and X in FIG. 1.
Figure 3:
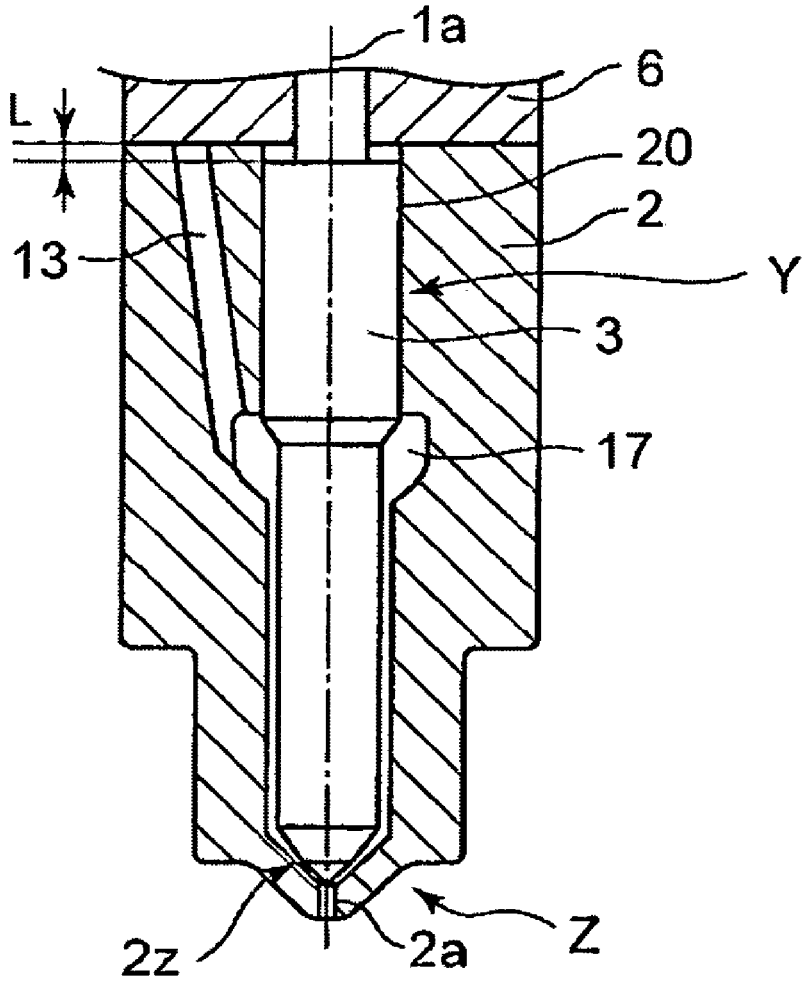
FIG. 3 is a partial cross section view of the pilot-fuel injection valve around a needle valve and a sliding periphery thereof, FIG. 4A explains a first example of the needle valve concerning the first embodiment, showing a part of a side view thereof.

FIG. 1 is a cross section view along a center axis of a valve showing a pilot-fuel injection valve applied to a gas engine concerning a first embodiment and a second embodiment of the present invention. FIG. 2 is a partial side view of said fuel injection valve, and FIG. 2A shows enlarged details of the parts Z and X in FIG. 1; FIG. 2B shows an enlarged detail of the part Y in FIG. 1; FIG. 3 shows a part of a cross section of the pilot-fuel injection valve around a needle valve and a sliding periphery thereof.

In FIGS. 1 to 3, the numeral 100 indicates an electromagnetic fuel injection valve assembly comprising a valve body 1, a nozzle tip 2 which is fastened fluid-tightly onto a bottom sealing face of a nozzle holder 6 by means of a nozzle nut 4 with a screw mechanism, a lower spacer 18 and an upper spacer 18*a* that are pressed fluid-tightly on a bottom sealing face of the valve body 1 by means of the nozzle nut 4 with a screw mechanism, a needle valve 3 which is inserted so as to slide with reciprocating movements into a borehole formed in the nozzle tip 2, a fuel pool 17, in the nozzle tip 2, communicated with a nozzle hole 2*a* which is perforated at a tip part (bottom front) of the nozzle tip 2, a center axis 1*a* of the fuel injection valve assembly 100, a pushrod 5 which is connected to an upper face of the needle valve 3, a needle valve spring 7 placed in between the pushrod 5 and a bottom face of the lower spacer 18 whereby the needle valve spring 7 biases the needle valve 3 in a direction to close the injection valve via the pushrod 5, a control piston 8 that is engaged in a borehole of the lower spacer 18 so as to slide therein, a lower end part of the piston 8 coming into contact with the pushrod 5, a fuel inlet 16 that is provided in a lateral part of the valve body 1, communicating with the fuel pool 17 through an upper fuel passage 15 perforated in the valve body 1, the upper/lower spacers 18*a*/18, and the nozzle holder 6 as well as a lower fuel passage 13 perforated in the nozzle tip 2, a solenoid 12, an armature 11, a connecting rod 9 that is connected to the armature 11, a return spring 10 that is placed in between the connecting rod 9 and the valve body 1.

In the above-described electromagnetic fuel injection valve 100, when the solenoid 12 is excited and draws the armature 11 upward, the connecting rod 9 moves upward against a spring force of the return spring 10; consequently, the needle valve 3 moves upward against a spring force of the needle valve spring 7; thus, the needle valve 3 opens a fuel flow channel between a seat surface of the needle valve and a valve seat of the nozzle tip.

When the needle valve opens the above-mentioned channel, the fuel accumulated from the fuel inlet 16 to the fuel pool 17 is injected into an engine cylinder (not shown) through the nozzle hole 2*a*.

A First Embodiment

Figure 4B:
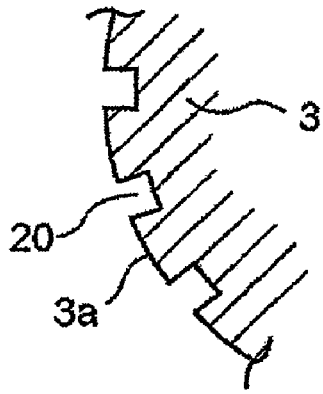
FIG. 4B is an A-A cross section view of FIG. 4A.
Figure 4A:
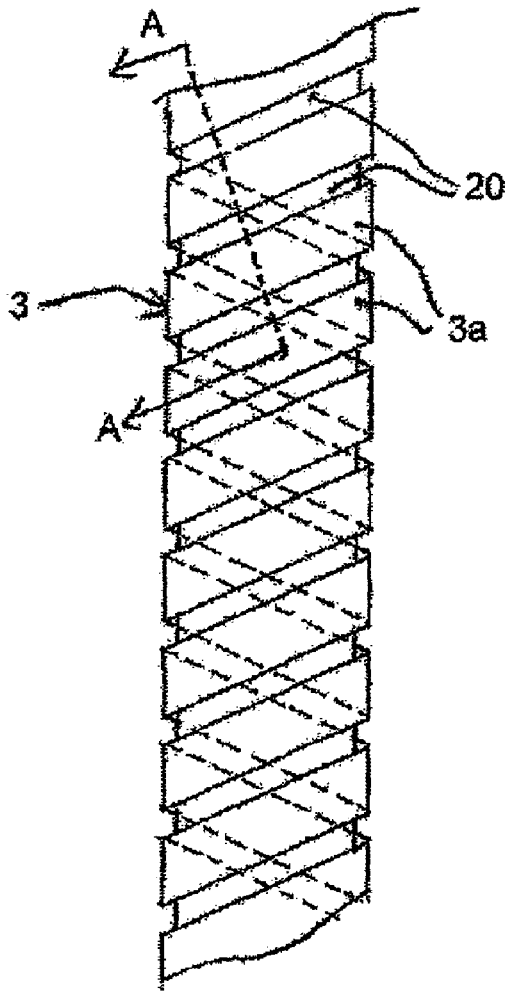

Referring to the first embodiment, FIG. 4A explains a first example of the needle valve, showing a part of a side view thereof and FIG. 4B shows an A-A cross-section view of FIG. 4A. Referring to the first embodiment, FIG. 5A explains a second example of the needle valve, showing a part of a side view thereof and FIG. 5B shows a B-B cross-section view of FIG. 5A.

Figure 6:
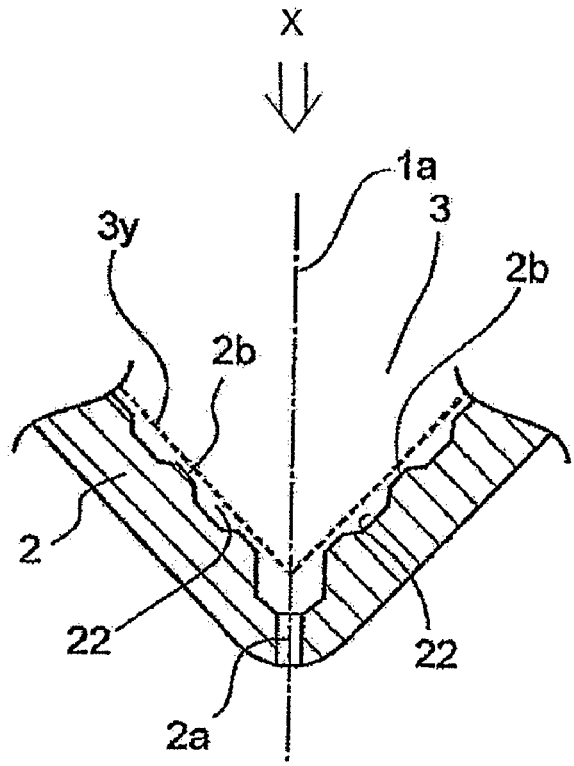
FIG. 6 is an enlarged sectional view of a seat surface of the needle valve tip (a C-C cross section view of FIG. 7 and a D-D cross section view of FIG. 8).
Figure 7:
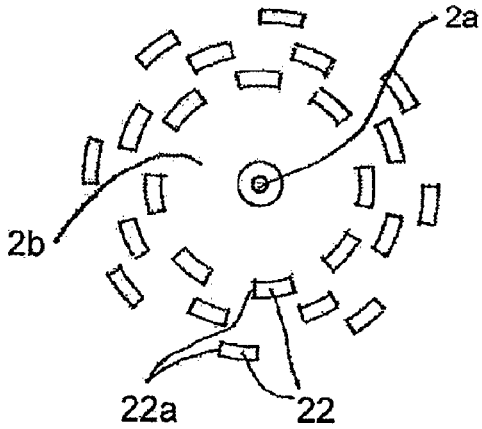
FIG. 7 is a partial side view showing the surface of the needle valve tip of two examples concerning the first embodiment.
Figure 7:
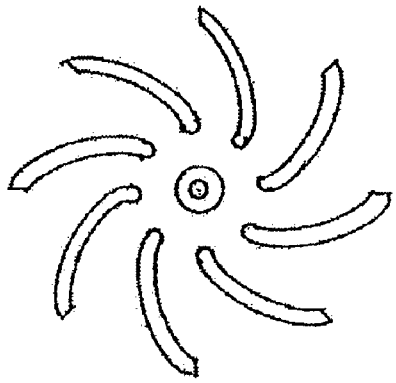
Figure 8:
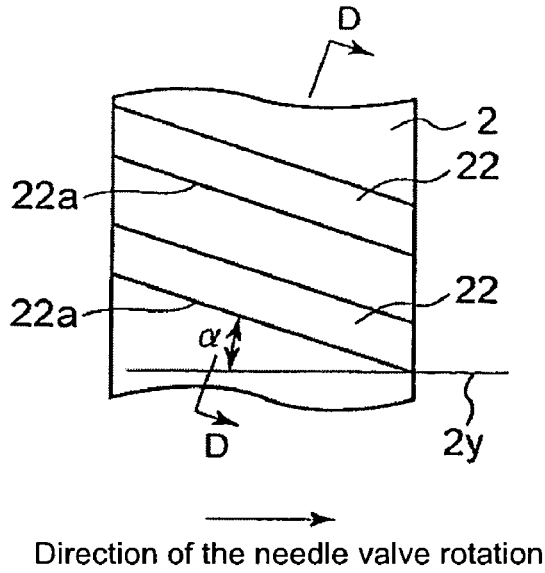
FIG. 8 is a partial side view of the seal surface of the needle valve tip of a second example concerning the first embodiment, FIG. 9A explains a first example of the needle valve showing a partial side view thereof concerning the second embodiment.

Further, concerning the first embodiment, FIG. 6 is an enlarged sectional view of a seat surface of the needle valve tip (a C-C cross section view of FIG. 7 and a D-D cross section view of FIG. 8), FIG. 7 is a partial side view showing the surface of the needle valve tip of two examples concerning the first embodiment, and FIG. 8 is a partial side view of the seal surface of the needle valve tip of a second example concerning the first embodiment.

Figure 5B:
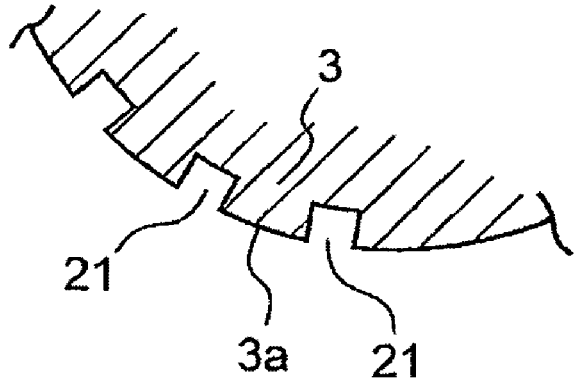
FIG. 5B is a B-B cross section view of FIG. 5A.
Figure 5A:
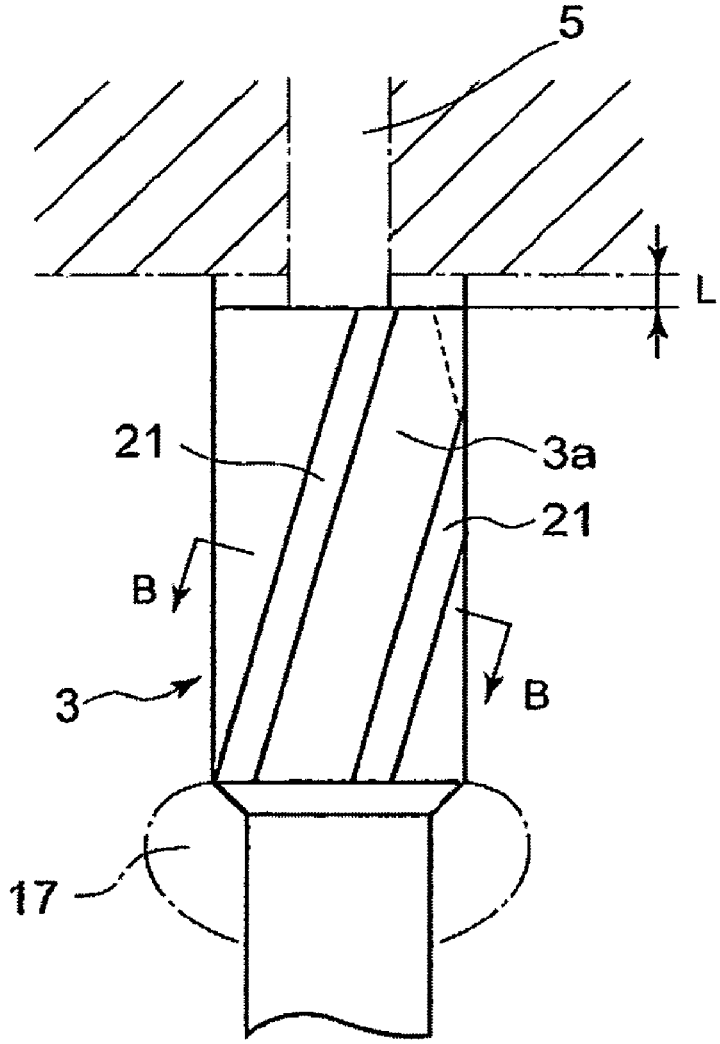
FIG. 5A explains a first example of the needle valve concerning the first embodiment, showing a part of a side view thereof.

The above first embodiment combines the two; the needle valve described in FIG. 4A and FIG. 4B explaining the first example of the needle valve, and in FIG. 5A and FIG. 5B explaining the second example of the same; the seat surface in the nozzle tip of FIG. 6 and FIG. 7 which show examples of the seat surface in the nozzle tip, and of FIG. 6 and FIG. 8 which show the second example of the same.

Namely, in the first embodiment of the needle valve 3, a first groove is engraved on an outer surface 3*a* of the needle valve 3 so that the groove is connected to a fuel pool 17 at a lower end, and the fuel can be guided in the groove, while the groove is communicated with an outer space above an upper face of the needle valve.

More specifically, in the first example of the first embodiment of the needle valve 3 as shown in FIGS. 4A and 4B, a spiral groove 20 as the first groove is formed on the outer surface of the needle valve, being placed spirally along the center axis of the needle valve; thereby, the spiral groove 20 is connected to a fuel pool 17 at a lower end, and the fuel can be guided in the groove, while the groove is communicated with an outer space above an upper face of the needle valve; consequently, the needle valve can be rotated in response to fuel movements in the groove 20.

Further, in the second example of the first embodiment of the needle valve 3 as shown in FIGS. 5A and 5B, an inclined groove 21 that is formed on the outer surface of the needle valve; thereby, the inclined groove 21 as the first groove is connected to a fuel pool 17 at a lower end, and the fuel can be guided in the groove, while the groove is communicated with an outer space above an upper face of the needle valve; consequently, the needle valve can be rotated in response to fuel movements in the groove 20.

In addition, in the first embodiment, a seat part (a seat cone 2*z*) of the nozzle tip comprises:

a seat surface 2*b* of the nozzle tip 2 which a seat surface 3*y* of the needle valve 3 comes in contact with, and a plurality of second grooves engraved on the surface 2*b*, thereby the second grooves 22 are placed along hoop circles of the valve needle rotation, or uniformly-twisted or uniformly-inclined directions against the hoop direction.

In the first example in the first embodiment of the seat part as shown in FIGS. 6 and 7, the second grooves 22 are placed intermittently along discontiguous hoop circles (or a hoop circle) on the seat cone 2*z*.

Further, in the second example as shown in FIGS. 6 and 8, the second grooves 22 are placed side by side in inclined directions against the hoop circles on the seat cone so that the lines (curves) of the grooves intersect the hoop circles (lines in hoop directions) 2*y* with an angle $\alpha$; hereupon, plural rows of grooves may be replaced by one groove.

Moreover, in both the first example and the second example, a part of the periphery contour of the second grooves 22 comprises a sharp edge 22*a* which scrapes-off deposited solid-materials of the fuel which adhere to the seat surfaces of the needle valve and the nozzle tip into the second grooves 22 with a help of the relative rotational movements of the needle valve 3 between the seat surfaces 3*y* and 2*b*.

As shown in FIG. 6, the second groove preferably has a cross section profile of a trapezoid broadening toward the outside; however, the profile may be of a rectangle or of a crescent as long as a part of the periphery contour of the second groove 22 comprises the sharp edge 22*a*.

According to the above first embodiment, the first groove is engraved on the outer periphery surface of the needle valve 3 so that the groove is connected to a fuel pool 17 at a lower end, and the fuel can be guided in the groove, while the groove is communicated with an outer space of a substantially ambient pressure, above an upper face of the needle valve 3. More specifically, as shown in FIGS. 4A and 4B that depict the first example of the needle valve, the first groove is formed with a spiral groove 20, spirally along the center axis of the needle valve, or as shown in FIGS. 5A and 5B that depict the second example of the needle valve, the first groove is formed of a plurality of inclined grooves 21, the grooves being inclined against the needle longitudinal direction. Whether the first groove is the spiral groove 20 or the inclined groove 21, the needle valve 3 can be rotated in response to the reciprocating movements of the needle valve 3 as well as the movements of the fuel guided into the groove 20.

Further, according to the above first embodiment, a plurality of the second grooves 22 are engraved on the seat surface 2*b* of the nozzle tip 2 so that the second grooves 22 are placed along hoop circles of the needle valve rotation, or in uniformly-twisted or uniformly-inclined directions against the hoop directions. A part of the periphery contour of the second groove 22 comprises a sharp edge 22*a* that scrapes-off depositing solid-materials in the fuel the materials which adhere to the seat surfaces of the needle valve 3 and the nozzle tip 2; more specifically, a plurality of the second grooves are provided intermittently along discontiguous hoop circles of the needle valve rotation, as shown in FIGS. 6 and 7 as to the first mode in the first embodiment of the seat part (seat cone), or a plurality of the second grooves are provided in uniformly-twisted or uniformly-inclined directions against the hoop directions as to the needle valve rotation, as shown in FIGS. 6 and 8 as to the second example in the first embodiment of the seat part (seat cone).

On the other hand, a part of fuel accumulated in the fuel pool 17 flows in the first groove (the spiral groove or the inclined groove) of the needle valve 3, and the groove which communicates the fuel pool 17 of a higher pressure to the space above the needle valve of a substantially ambient pressure. Thereby, the fuel flow makes the needle valve rotate, and in response to the rotational movements of the needle valve as well as through the fuel flow, solid foreign matters such as foreign substances, impurities, or combustion residues in fuel the matters which are apt to enter a sliding clearance around the needle valve can easily be carried away into the first groove. Further, the solid foreign matters can be easily discharged toward the air space of ambient pressures. Consequently, damage of the foreign matters on the outer surface of the needle valve can be evaded.

Thus, a malfunction and/or seizure of the needle valve that are caused by inclusion of solid foreign matters in the fuel can be surely prevented, where the solid foreign matters denote substances such as foreign substances, impurities, or combustion residues in fuel the matters which are apt to enter a sliding clearance around the needle valve.

Through the rotational movements of the needle valve 3 with the fuel flow in the first groove, as well as through the sharp edge (a keen edge part of the contour edge) 22*a* of the second grooves (a plurality of the second grooves) that are provided in uniformly-twisted or uniformly-inclined directions against the hoop directions as to the needle valve rotation, the sharp edge scrapes-off deposited solid-materials from the fuel. The materials that adhere to the seat surfaces of the needle valve 3 and the nozzle tip 2, solid-foreign substances are scraped-off into the second grooves, substances such as foreign substances, impurities, or combustion residues in fuel which are apt to enter a clearance between the tip part of the needle valve 3 and the seat part 2*z* (a seat cone) in the nozzle tip 2.

As a result, an inclusion of the solid foreign-substances around the seat part 2*z* can be withstood and an irregular injection and an incomplete combustion are prevented.

A Second Embodiment

Figure 9B:
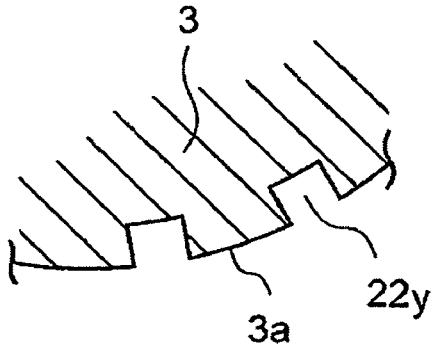
FIG. 9B is an E-E cross section view of FIG. 9A, FIG. 10A explains a second example of the needle valve showing a partial side view thereof.
Figure 9A:
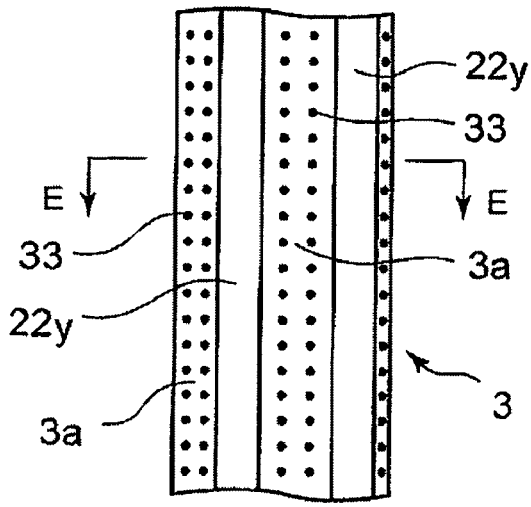
Figure 10B:
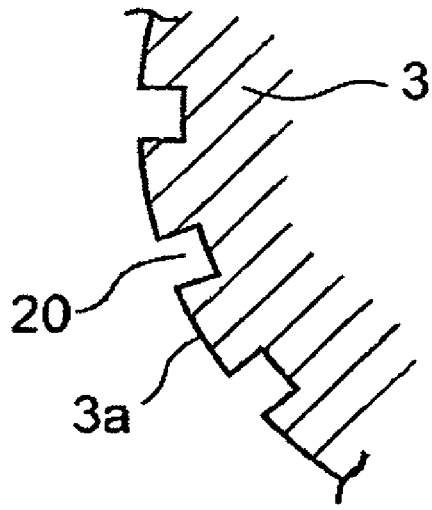
FIG. 10B is an F-F cross section view of FIG. 10A.

Concerning the second embodiment, FIG. 9A explains a first example of the needle valve showing a partial side view thereof concerning the second embodiment, and FIG. 9B is an E-E cross section view of FIG. 9A. Concerning the second embodiment, FIG. 10A explains a second example of the needle valve showing a partial side view thereof, FIG. 10B is an F-F cross section view of FIG. 10A In this second embodiment, on an outer periphery 3*a* of the needle valve 3, grooves 20 (22*y*) are engraved so that a part of the fuel can flow therein. Further, on the outer periphery 3*a*, a process of shot-peening 33 is performed.

Namely, as shown in FIGS. 9A and 9B, in a first example of the second embodiment, an axial direction groove 22*y* is engraved on the outer periphery 3*a* of the needle valve 3 in which the grooves 22*y* are connected to the fuel pool 17 at a lower end and connected to the outer space toward the air space so that a part of the fuel can enter and go up the grooves 22*y* to be flown out to the outer space toward the air space.

On the outer periphery 3*a* of the needle valve 3 where the grooves 22*y* are not engraved, a process of shot-peening 33 is performed.

Figure 10A:
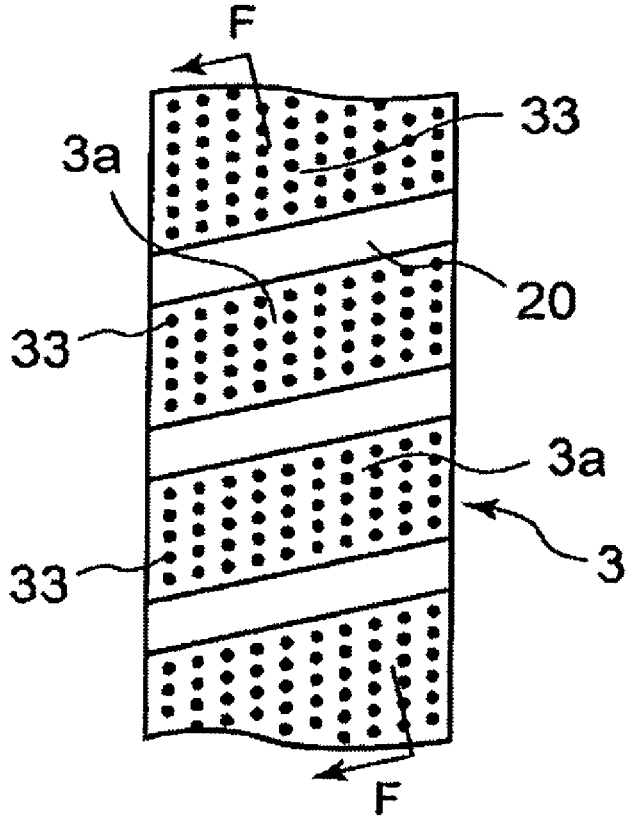

As shown in FIGS. 10A and 10B, in a second example of the second embodiment as to the needle valve 3, on the outer periphery 3*a* of the needle valve 3, spiral grooves 20 are provided in a similar way shown in FIGS. 4A and 4B (the first embodiment) in which the grooves 20 are connected to the fuel pool 17 at a lower end and connected to the outer space toward the air space so that a part of fuel can enter and go up the grooves 20 to be flown out to the outer space toward the air space.

Further, on the outer periphery 3*a* of the needle valve 3 where the grooves 20 are not engraved, a process of shot-peening 33 is performed.

Moreover, although an explanation figure is omitted, the above-mentioned first grooves (the spiral grooves 20) can be alternated with a plurality of inclined grooves 21 as shown in FIGS. 5A and 5B, in which the grooves 21 are connected to the fuel pool 17 at a lower end and connected to the outer space toward the air space. Again, on the outer periphery 3*a* of the needle valve 3 where the grooves 21 are not engraved, a process of shot-peening 33 is performed.

According to the above second embodiment, the grooves are engraved on the outer periphery surface of the needle valve 3 so as to induce a part of the fuel into the grooves; more specifically, the grooves are engraved as one of:

a plurality of axial direction grooves 22*y* that is formed on the outer surface of the needle valve, being placed along a center axis of the needle valve, spiral grooves 20 formed on the outer surface of the needle valve, being placed spirally along the center axis of the needle valve, or inclined grooves 21 (as shown in FIGS. 5A and 5B) that are formed on the outer surface of the needle valve, being inclined against the needle longitudinal direction and also being connected to the fuel pool at a lower end so that fuel can be guided into the grooves, while being connected to the upper end face of the valve needle at an upper end of the inclined groove.

Consequently, due to the shot-peening 33 performed on the outer periphery 3*a*, solid foreign matters such as foreign substances, impurities, or combustion residues, which are apt to enter the outer periphery 3*a*, flow into the grooves 22*y*, 20, or 21, thereby evading inclusion of the solid foreign matters on the outer periphery 3*a* of the needle valve 3. Moreover, a process of shot-peening 33 is performed on the outer periphery 3*a* of the needle valve 3 where the groove 21 is not engraved; thereby, fuel (as a certain lubricant) can be held within the microscopic depressions (dimples). Thus, lubrication performance between the mutually sliding surfaces of the needle 3 outer periphery and the nozzle tip 2 bore can be enhanced; further, wear resistance of the sliding surfaces is enhanced due to increased hardness of the needle outer periphery 3*a*.

According to the second embodiment, inclusion of solid foreign matters on the outer periphery 3*a* of the needle valve 3 can be evaded, where solid foreign matters denote substances such as foreign substances, impurities, or combustion residues in fuel. In addition, lubrication performance as well as wear resistance of the mutually sliding surfaces of the needle 3 outer periphery and the nozzle tip 2 bore can be enhanced.

Another Embodiment

Besides the first and second embodiments, the first groove in the present invention may optionally be provided on a control piston 8 shown in a detail X of FIG. 1 and in FIG. 2A, whereby fuel accumulated in a spring space 7*z* in which a needle valve spring 7 is accommodated is guided into this first groove.

Even in relation to the engines that use fuel containing foreign substances to a considerable extent, the present invention can provide a fuel injection valve that can prevent an attack of solid foreign matters such as foreign substances, impurities, or combustion residues in fuel, on the contacting seat surfaces of a needle valve and/or a nozzle tip, and on the sliding surfaces of the needle valve periphery and/or a corresponding borehole in the nozzle tip, a malfunction and/or seizure of the needle valve through the mentioned attack, and incomplete combustion due to irregular injections.

The invention claimed is:

1. A fuel injection valve for injecting fuel into an engine cylinder, the fuel injection valve comprising:

a needle valve including:

a tip;

a seat surface; and a first groove engraved on an outer surface of the needle valve for guiding the fuel, the first groove having upper and lower ends, the upper and lower ends of the first groove being open, the needle valve being rotatable by the fuel flowing in the first groove and in response to a reciprocating movement of the needle valve; and a nozzle tip including:

a borehole;

at least one nozzle hole perforated in a neighborhood of a tip of the nozzle tip;

a seat surface; and a plurality of second grooves engraved on the seat surface of the nozzle tip, the plurality of second grooves being arranged along respective directions inclined relative to a longitudinal direction of the nozzle tip, and inclined relative to a rotational direction of the needle valve, at least one second groove of the plurality of second grooves comprising a sharp edge for scraping-off deposited solid materials adhered to the seat surface of the needle valve, into the at least one second groove, by relative rotational movement between the seat surface of the nozzle tip and the seat surface of the needle valve, wherein the needle valve is fitted slidably in the borehole formed in the nozzle tip, and wherein a fuel flow passage between the seat surface of the needle valve tip and the seat surface of the nozzle tip is opened/closed by the reciprocating movement of the needle valve.

2. The fuel injection valve according to claim 1, wherein the first groove is one of a plurality of first spiral grooves formed on the outer surface of the needle valve, the plurality of first spiral grooves being placed spirally about a center axis of the needle valve, and wherein the first groove is configured to be connected to a fuel pool at a lower end so that fuel can be guided in the first groove, and connected to an upper end face of the needle valve.

3. The fuel injection valve according to claim 1, wherein the first groove is one of a plurality of inclined grooves formed on the outer surface of the needle valve, the plurality of inclined grooves being inclined relative to a longitudinal direction of the needle valve, and wherein the first groove is configured to be connected to a fuel pool at a lower end so that fuel can be guided in the first groove, and connected to an upper end face of the needle valve.

4. A fuel injection valve for injecting fuel into an engine cylinder, the fuel injection valve comprising:

a needle valve including:

a tip;

a seat surface; and a first groove engraved on an outer surface of the needle valve for guiding the fuel, the first groove having upper and lower ends, the upper and lower ends of the first groove being open, the needle valve being rotatable by the fuel flowing in the first groove and in response to a reciprocating movement of the needle valve; and a nozzle tip including:

a borehole;

at least one nozzle hole perforated in a neighborhood of a tip of the nozzle tip;

a seat surface; and a plurality of second grooves engraved on the seat surface of the nozzle tip, a group of second grooves of the plurality of second grooves being intermittently engraved on the seat surface of the nozzle tip in a shape of a circle, at least one second groove of the plurality of second grooves comprising a sharp edge for scraping-off deposited solid materials adhered to the seat surface of the needle valve, into the at least one second groove, by relative rotational movement between the seat surface of the nozzle tip and the seat surface of the needle valve, wherein the needle valve is fitted slidably in the borehole formed in the nozzle tip, and wherein a fuel flow passage between the seat surface of the needle valve tip and the seat surface of the nozzle tip is opened/closed by the reciprocating movement of the needle valve.

5. The fuel injection valve according to claim 4, wherein the second grooves of the plurality of second grooves are intermittently engraved on the seat surface of the nozzle tip in a shape of two or more discontiguous circles.

6. A fuel injection valve for injecting fuel into an engine cylinder, the fuel injection valve comprising:

a needle valve including:

a tip;

a seat surface; and a first groove engraved on an outer surface of the needle valve for guiding the fuel, the first groove having upper and lower ends, the upper and lower ends of the first groove being open, the needle valve being rotatable by the fuel flowing in the first groove and in response to a reciprocating movement of the needle valve; and a nozzle tip including:

a borehole;

at least one nozzle hole perforated in a neighborhood of a tip of the nozzle tip;

a seat surface; and a plurality of second grooves engraved on the seat surface of the nozzle tip, the plurality of second grooves comprising a plurality of uninterrupted line grooves engraved on the seat surface of the nozzle tip, uninterrupted line grooves of the plurality of uninterrupted line grooves being disposed along directions inclined relative to a longitudinal direction of the nozzle tip, and inclined relative to a rotational direction of the needle valve, at least one second groove of the plurality of second grooves comprising a sharp edge for scraping-off deposited solid materials adhered to the seat surface of the needle valve, into the at least one second groove, by relative rotational movement between the seat surface of the nozzle tip and the seat surface of the needle valve, wherein the needle valve is fitted slidably in the borehole formed in the nozzle tip, and wherein a fuel flow passage between the seat surface of the needle valve tip and the seat surface of the nozzle tip is opened/closed by the reciprocating movement of the needle valve.

* * * * *